US007445204B2

(12) United States Patent
Okamoto

(10) Patent No.: US 7,445,204 B2
(45) Date of Patent: Nov. 4, 2008

(54) FEEDING METHOD OF PRINTING MEDIUM AND PRINTING APPARATUS

(75) Inventor: Akira Okamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 494 days.

(21) Appl. No.: 11/202,209

(22) Filed: Aug. 12, 2005

(65) Prior Publication Data

US 2006/0039019 A1 Feb. 23, 2006

(30) Foreign Application Priority Data

Aug. 18, 2004 (JP) ..... 2004-238863

(51) Int. Cl.
*B65H 5/00* (2006.01)

(52) U.S. Cl. ..... 271/10.02; 271/258.01; 271/258.03; 271/265.01

(58) Field of Classification Search ..... 271/10.02, 271/10.03, 258.01, 258.03, 265.01; 347/104
See application file for complete search history.

(56) References Cited

U.S. PATENT DOCUMENTS 5,056,771 A * 10/1991 Beck et al. ..... 271/114
5,415,387 A * 5/1995 Suzuki ..... 271/10.02
5,676,363 A * 10/1997 Kishida et al. ..... 271/10.01
5,692,741 A * 12/1997 Nakamura et al. ..... 271/10.03
6,158,731 A * 12/2000 Nakagawa ..... 271/11
6,421,581 B1 7/2002 Hamamoto et al. ..... 700/223
6,874,778 B2 4/2005 Nakano et al. ..... 271/111
7,357,387 B2 * 4/2008 Asada ..... 271/110
2001/0022422 A1 * 9/2001 Tamura ..... 271/10.03
2002/0066994 A1 6/2002 Nakano et al. ..... 271/121
2004/0041869 A1 3/2004 Horiuchi et al. ..... 347/16

FOREIGN PATENT DOCUMENTS

JP 2002-187634 7/2002
JP 2002-205838 7/2002
JP 2004-082640 3/2004

* cited by examiner

*Primary Examiner*—David H Bollinger
(74) *Attorney, Agent, or Firm*—Fitzpatrick, Cella, Harper & Scinto

(57) ABSTRACT

When a to-be-transported printing medium is fed in association with an operation for transporting the printing medium to a predetermined printing start position, a control is provided so as to eliminate an emergency stop of the feeding operation that tends to be caused due to an increase in the printing speed, thereby realizing a high-speed printing. To provide this, prior to a determination of the printing start position, the feeding by a feeding roller of the printing medium is started. Thereafter, when the printing start position is fixed within a predetermined period after the detection of a front end of the printing medium, whether or not to stop the feeding roller is determined at this timing. The predetermined period is a period during which the printing medium can be stopped at a predetermined stop position at which the printing medium is not yet caught by a transportation roller.

9 Claims, 15 Drawing Sheets

FEEDING METHOD OF PRINTING MEDIUM AND PRINTING APPARATUS

BACKGROUND OF THE INVENTION

1. Field of the Invention

The present invention relates to a feeding method of a to-be-transported printing medium for feeding the printing medium in association with an operation for transporting the printing medium to a predetermined printing start position and a printing apparatus.

2. Description of the Related Art

Among image formation apparatuses (printing apparatus) such as a printer, the one has an image formation section such as a printing section that includes a paper feeding apparatus for feeding sheets (printing media) one by one.

The paper feeding apparatus as described above has a structure as shown in FIG. 8A to FIG. 8F for example in which a feeding roller 2 is abutted with the sheet S in a pressurized manner so that the sheet S receives a transportation force. The paper feeding apparatus as described above is also structured such that separation means 7 composed of a separation pad, a separation nail, and a separation bank or the like applies a transportation load to the sheet S so that only the sheet S at the top other than the remaining sheets S at the lower side can be separated. The separated sheet S is sent to a transportation roller 11 by the clockwise rotation of the feeding roller 2 (FIG. 8A to FIG. 8C) and is further transported by both of the feeding roller 2 and the transportation roller 11 (FIG. 8D). When the feeding roller 2 is rotated 360 degrees, then the pressurized contact between the sheet S and the feeding roller 2 is cancelled (FIG. 8E). Thereafter, the sheet S is transported only by the transportation roller 11 to a predetermined printing start position (FIG. 8F).

By the way, in order to reduce the size of an apparatus such as a printing apparatus or to reduce the time required for the sheet S to be fed, it is required to reduce the distance from the feeding roller 2 to a printing head unit (printing section) 13. However, when the distance between them is reduced, some data to be printed may cause a situation in which, when the transportation of the sheet S is performed as shown in FIG. 9A to FIG. 9E, a transportation-completed position PA of the sheet S by the feeding roller 2 comes ahead of the printing start position PB (FIG. 9F). In this case, in order to return the sheet S to the printing start position PB as shown in FIG. 9F, the transportation roller 11 must be rotated in the reverse direction.

Japanese Patent Application Laid-open No. 2002-205838 discloses a paper (sheet) feeding apparatus in which, when the transportation of a sheet is started, a transportation roller in a stoppage status is abutted with the sheet by a feeding roller to subsequently transport the sheet. When a sheet is abutted with the transportation roller in a pressurized manner, a loop is formed. Then, the posture of the sheet is corrected so that the front end of the sheet is parallel to the transportation roller to subsequently transport the sheet to a printing start position by the feeding roller and the transportation roller. Hereinafter, such a paper feeding method will be described as "abutting-type paper feeding".

Japanese Patent Application Laid-open No. 2002-187634 discloses a method by which, when the front end of a sheet fed by a feeding roller reaches a transportation roller, the transportation roller is already rotated so that the sheet is continuously transported by the transportation roller to the printing start position. Hereinafter, this paper feeding method will be referred to as "no-registration paper feeding (no-position-adjustment paper feeding)". This "no-registration paper feeding" has an inferior accuracy of a printing start position when compared to that of "abutting-type paper feeding" but can reduce a time required for a paper feeding.

Japanese Patent Application Laid-open No. 2004-082640 discloses "simultaneous control of paper ejection and paper feeding" in which, when a plurality of sheets are subjected to a printing operation, an operation for ejecting an already-printed sheet (current page) and an operation for feeding a sheet to be printed next (next page) are performed simultaneously. When this control is applied to "no-registration paper feeding", an image is printed on the sheet SA as a current page as shown in FIG. 10A and the printing of the final data to the sheet SA is finished at which the feeding of the sheet SB as a next page is started (FIG. 10B). As a result, an operation for ejecting the sheet SA as a current page and an operation for transporting the sheet SB as a next page to a printing start position can be performed simultaneously (FIG. 10B to FIG. 10G). The result is that the distance between the rear end of the sheet SA as a current page and the front end of the sheet SB can be reduced to improve the rate at which a plurality of pages are printed.

However, when the distance from the paper feeding roller 2 to the printing start position PB at which the printing of the sheet SB as a next page is started is small, "simultaneous control of paper ejection and paper feeding" may cause a problem as described below.

First, as shown in FIG. 11A, an image is printed on the sheet SA as a current page and the printing of the final data to the sheet SA is finished at which the feeding of the sheet SB as a next page is started (FIG. 11B). In this way, an operation for ejecting the sheet SA and an operation for transporting the sheet SB by the feeding roller 2 are performed simultaneously (FIG. 11B to FIG. 11F). In this case, the transportation-completed position PA of the sheet SA by the 360-degree rotation of the feeding roller 2 (FIG. 11F) may come ahead of the printing start position PB (FIG. 11G). In such a case, the transportation roller 11 is rotated in the reverse direction to return the sheet SB to the printing start position PB as shown in FIG. 11G. When this is performed, a risk is caused in which the sheet SA as a current page being ejected is also transported in the reverse direction to cause the rear end of the sheet SA to collide with the transportation roller 11 or the printing section 13 to be bent or damaged.

The risk as described above in which the sheet SA being ejected may be transported by the transportation roller 11 in the reverse direction has been handled by a conventional "simultaneous control of paper ejection and paper feeding" in such a manner in which the feeding roller 2 and the transportation roller 11 are controlled so that the feeding of the sheet SB as a next page can be subjected to an emergency stop. FIG. 13 is a flowchart illustrating the procedure of the control of these rollers 2 and 11.

When a paper ejection instruction for the sheet SA as a current sheet is received (Step S31) and the sheet SB as a next page exists, "simultaneous control of paper ejection and paper feeding" is started (Step S32). First, a transportation motor for rotating the transportation roller 11 receives an instruction for an operation for ejecting the sheet SA as a current page and a paper feeding motor for rotating the feeding roller 2 receives an instruction for rotating the feeding roller 2 360 degrees (Step S33). Next, the reception of a paper feeding instruction is waited (Step S34). Thereafter, the completion of the 360-degree rotation of the feeding roller 2 (Step S35) and the detection by a sheet end section detection sensor (PE sensor) of the existence of a paper (Step S36) are waited. As shown by "1*f*" of FIG. 11A, the PE sensor detects the front end and the rear end of the sheet by the rotation of the actuator 10 around the axis 10*a*. This PE sensor 1*f* detects the existence of a paper (existence of sheet) by the rotation of the lower end of the actuator 10 by the sheet.

When the 360-degree rotation of the feeding roller 2 is completed without the detection by the PE sensor 1*f* of the existence of a paper, then the absence of paper (absence of sheet) is determined and an error processing is provided to complete the entire processing (Step S37). When the PE sensor 1*f* detects the existence of a paper, whether the printing start position PB of the sheet SB is fixed or not is determined (Step S38). When the printing start position PB of the sheet SB is not fixed, then an emergency stop instruction is given to the paper feeding motor (Step S39) and the completion of the ejection of the sheet SA by the transportation motor is waited (Step S40). Thereafter, the fixation of the printing start position PB of the sheet SB is waited (Step S41). Then, when the printing start position PB is fixed, the operations of the paper feeding motor and the transportation motor are newly started (Step S42). Then, the processing proceeds to Step S47 (which will be described later).

On the other hand, when Step S38 already fixes the printing start position PB, based on the relation between degrees required for the feeding roller 2 to be rotated in order to complete a 360-degree rotation and the printing start position PB, whether the transportation roller 11 needs to be rotated in the reverse direction or not is determined (Step S43). Specifically, the transportation-completed position PA of the sheet SB when the 360-degree rotation of the feeding roller 2 is completed is estimated so that, when the transportation-completed position PA comes ahead of the printing start position PB as shown in FIG. 11F, it is determined that the reverse rotation of the transportation roller 11 for returning the front end of the sheet SB to the printing start position PB as shown in FIG. 11G is required. On the other hand, when the transportation-completed position PA does not come ahead of the printing start position PB, it is determined that the reverse rotation of the transportation roller 11 is not required.

When it is determined that the reverse rotation of the transportation roller 11 is required, an emergency stop instruction is given to the paper feeding motor (Step S44) and the feeding of the sheet SB is stopped. Then, the completion of the ejection of the sheet SA by the transportation motor is waited (Step S45). Thereafter, the operations of the paper feeding motor and the transportation motor are newly started (Step S46) and the processing proceeds to Step S47 (which will be described later). On the other hand, when Step S43 determines that the reverse rotation of the transportation roller 11 is not required, then the processing directly proceeds to Step S47.

In Step S47, the 360-degree rotation of the feeding roller 2 is completed and then the forward or reverse rotation of the transportation roller 11 causes the sheet SB to be transported to the printing start position PB, thereby completing the processing.

In "simultaneous control of paper ejection and paper feeding" as described above, the paper feeding motor is controlled by the procedure shown in the flowchart of FIG. 14. This processing is performed by an interrupt by a cycle timer.

When an instruction for the operation of the paper feeding motor is received, then the paper feeding motor is firstly acceleration-controlled until the acceleration of the feeding roller 2 is completed (Steps S51 and S52). When the acceleration is completed, the feeding roller 2 is constant speed-controlled (Step S53). The constant speed control is continued until an emergency stop instruction is received or the 360-degree rotation of the feeding roller 2 is obtained (Steps S54 and S55). After the constant speed control, the feeding roller 2 is deceleration-controlled until the deceleration of the feeding roller 2 is completed (Steps S56 and S57).

FIG. 12A to FIG. 12I illustrate an operation for a case in "simultaneous control of paper ejection and paper feeding" as described above in which the printing start position PB of the sheet SB comes ahead of the transportation-completed position PA.

First, in accordance with a timing at which the printing of the final data to the sheet SA as a current page is completed, an operation for ejecting the sheet SA and an operation for feeding the sheet SB as a next page are simultaneously started as shown in FIG. 12A and FIG. 12B (Step S33). The sheet SB is fed as shown in FIG. 12C and the front end is detected by the PE sensor if as shown in FIG. 12D. In the case of this example, the printing start position PB is already fixed when the existence of a paper is detected by the PE sensor 1*f* and it is estimated that the transportation-completed position PA comes ahead of the printing start position PB. Thus, it is determined that the reverse rotation of the transportation roller 11 is required. Thus, the processing proceeds from Step S36 to Steps S38, S43, and S44 and an emergency stop instruction is given to the paper feeding motor. As a result, the processing proceeds from Step S54 to Step S56 in FIG. 14 and the paper feeding motor is deceleration-controlled and the feeding roller 2 is stopped as shown in FIG. 12E.

Thereafter, the completion of the operation for ejecting the sheet SA is waited. Then, Step S46 starts the operations of the paper feeding motor and the transportation motor again and the feeding roller 2 and the transportation roller 11 are rotated as shown in FIG. 12F and FIG. 12G. Then, Step S47 transports the sheet SB to the transportation-completed position PA by the 360-degree rotation of the feeding roller 2 as shown in FIG. 12H. Thereafter, the reverse rotation of the transportation roller 11 causes the sheet SB to reach the printing start position PB as shown in FIG. 12I.

When the reverse rotation of the transportation roller 11 is required in the "simultaneous control of paper ejection and paper feeding" as described above, the feeding of the sheet SB as a next page is temporarily stopped and the feeding of the sheet SB as a next page is not started until the ejection of the sheet SA as a current page is completed. Although this control causes the reduction of the printing speed, the problem due to the transportation of the sheet SA as a current page in the reverse direction can be avoided.

FIG. 15 illustrates the rotation position and speed change of the feeding roller 2 in the "simultaneous control of paper ejection and paper feeding" as described above.

When the driving of the paper feeding motor is started to rotate the feeding roller 2, one sheet SB is separated and fed and the front end of the sheet SB reaches the PE sensor 1*f* at which the time t1 is reached and the feeding roller 2 is at the rotation position "p1". These "p1" and "t1" change depending on the behavior of the sheet SB. At the time t1, the determination by Step S38 is provided. When the printing start position PB is not fixed until the time t1, Step S39 provides an emergency stop instruction for the paper feeding motor. As a result, the paper feeding motor is deceleration-controlled after the time t1 and is stopped at the position P2. The rotation position and speed of the feeding roller 2 change so as to draw the trajectory as shown by the broken line in FIG. 15. When the feeding roller 2 is stopped at the emergency stop position P2, the front end of the sheet SB is stopped at a position at which the sheet SB is not transported by the transportation roller 11 (i.e., a position sufficiently far away from the position p3 at which the sheet SB is caught by the transportation roller 11). The PE sensor 1*f* is provided in order to set the emergency stop position P2 so as to satisfy the conditions as described above.

When the printing start position PB is fixed in Step S38 and the next Step S43 determines that the reverse rotation of the transportation roller 11 is required, then Step S44 issues an emergency stop instruction to the paper feeding motor. Thus, the rotation position and speed of the feeding roller 2 change so as to draw the trajectory as shown by the broken line in FIG. 15.

When Step 43 determines that the reverse rotation of the transportation roller 2 is not required, then the feeding roller 2 is driven until the paper feeding is completed. Thus, the rotation position and speed of the feeding roller 2 change so as to draw the trajectory as shown by the solid line in FIG. 15.

However, in the "simultaneous control of paper ejection and paper feeding" of the conventional example, there may be a case in which an increased rotation speed of the feeding roller 2 for providing a high-speed printing causes the time t1 at which the detection by the PE sensor is provided to be earlier. As a result, it occurs more times that the processing of to-be-printed data cannot be completed until the time t1 and the printing start position is not fixed. In this case, a problem is caused in which the printing speed is reduced in spite of the increased rotation speed because the feeding roller 2 is frequently subjected to an emergency stop.

SUMMARY OF THE INVENTION

It is an objective of the present invention to provide a feeding method of a printing medium and a printing apparatus by which, when a to-be-transported printing medium is fed in association with an operation for transporting the printing medium to a predetermined printing start position, a control is provided so that an emergency stop of the feeding operation that tends to be caused due to the increase in the printing speed can be reduced as much as possible, thereby realizing a high-speed printing.

In the first aspect of the present invention, there is provided a printing apparatus in which a printing medium fed from feeding means is transported by transportation means to a printing start position to subsequently print an image on the printing medium, comprising:

end section detection means for detecting an end section of the printing medium fed by the feeding means; and control means for starting, before obtaining information regarding a printing start position, the feeding of the printing medium by the feeding means and for determining whether or not to stop the feeding means when obtaining the information regarding the printing start position within a predetermined period after the detection of a front end of the printing medium by the end section detection means, wherein the predetermined period is a period during which the printing medium can be stopped at a predetermined position before being caught by the transportation means.

In the second aspect of the present invention, there is provided a printing apparatus for printing an image on a printing medium, comprising:

feeding means for feeding the printing medium to transportation means for transporting the printing medium to a printing start position;

end section detection means for detecting an end section of the printing medium fed by the feeding means; and canceling means for canceling a stop condition for stopping the printing medium at a predetermined position at which the printing medium is fed for a predetermined distance after the detection of a front end of the printing medium by the end section detection means and at which the printing medium is not yet caught by the transportation means, wherein the canceling means obtains information regarding the printing start position within a period from the detection of the front end of the printing medium by the end section detection means to a timing at which a predetermined period has passed and determines, based on the obtained information, whether or not to cancel the stop condition and, when the stop condition is determined to be canceled, the canceling means cancels the stop condition.

In the third aspect of the present invention, there is provided a method for feeding a printing medium by feeding means to transportation means for transporting the printing medium to a printing start position, comprising:

a step of starting, prior to a obtainment of information regarding a printing start position, the feeding of the printing medium by the feeding means, a step of detecting an end section of the printing medium fed by the feeding means; and a step of determining whether or not to stop the feeding means when the information regarding the printing start position is obtained within a predetermined period after the detection of a front end of the printing medium in the end section detection step, wherein the predetermined period is a period during which the printing medium can be stopped at a predetermined position at which the printing medium is not yet caught by the transportation means.

In the fourth aspect of the present invention, there is provided a method for feeding a printing medium by feeding means to transportation means for transporting the printing medium to a printing start position, comprising:

a step of detecting an end section of the printing medium fed by the feeding means; and a step of canceling a stop condition for stopping the printing medium at a predetermined position at which the printing medium is fed for a predetermined distance after the detection of a front end of the printing medium in the end section detection step and at which the printing medium is not yet caught by the transportation means, wherein the canceling step obtains information regarding the printing start position within a period from the detection of a front end of the printing medium in the end section detection step to a timing at which a predetermined period has passed and determines, based on the obtained information, whether or not to cancel the stop condition and, when the stop condition is determined to be canceled, the canceling step cancels the stop condition.

According to the present invention, there may be a case in which a feeding means is not stopped even when a printing start position is not fixed until the front end of the printing medium is detected. Specifically, there may be a case in which, even when the front end of the printing medium is already detected, a feeding means is not stopped if the fixation of a printing start position is completed within a predetermined period. The predetermined period is a period during which the printing medium can be stopped at the predetermined stop position before being caught by the transportation means. Thus, the frequency of emergency stops of a feeding operation that tend to be caused due to the increase in the printing speed can be reduced when compared to conventional cases, thereby realizing a high-speed printing.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Hereinafter, embodiments of the present invention will be described with reference to the drawings.

Figure 1:
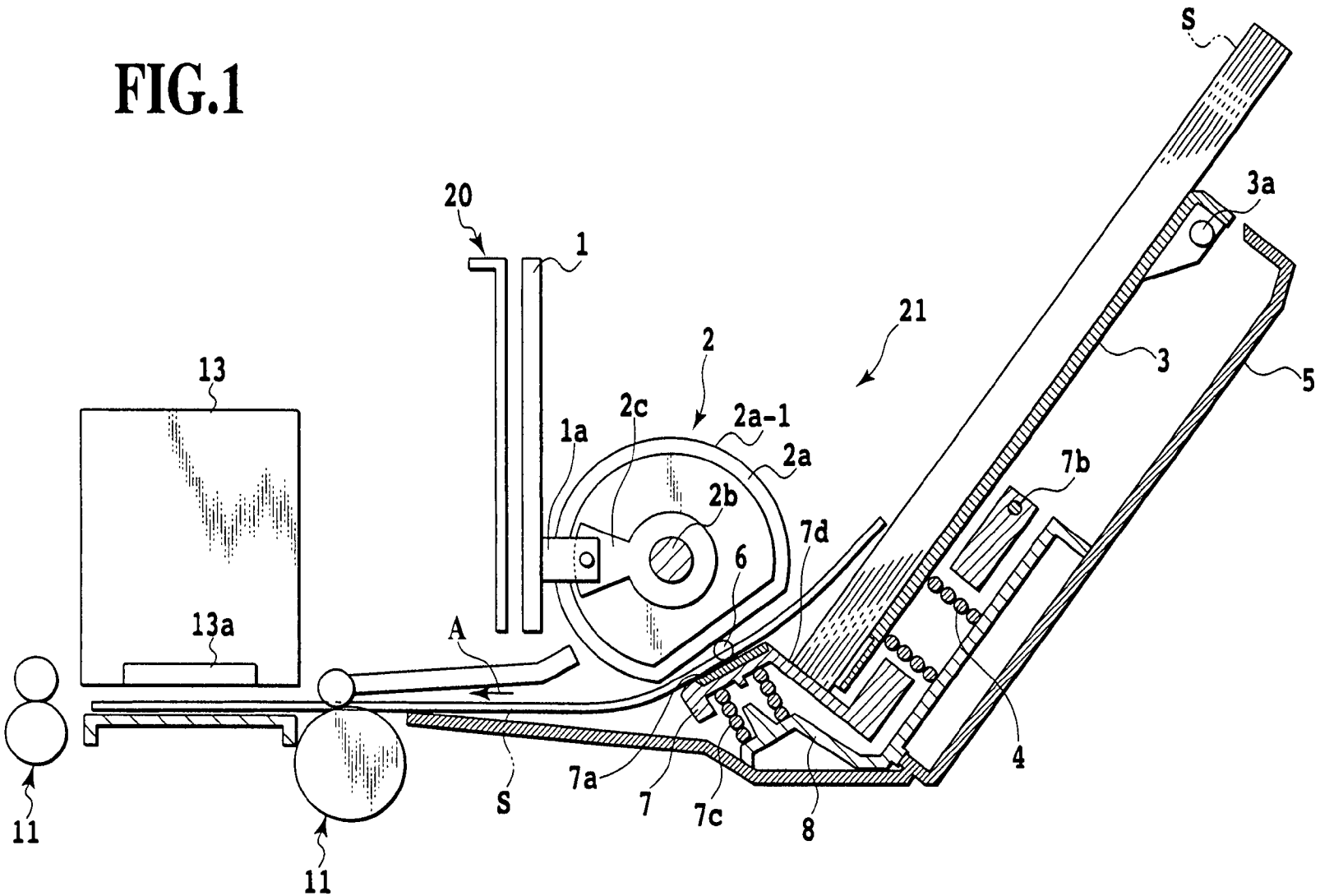
FIG. 1 is a schematic cross sectional view illustrating the main part of a printing apparatus of one embodiment of the present invention.
Figure 2:
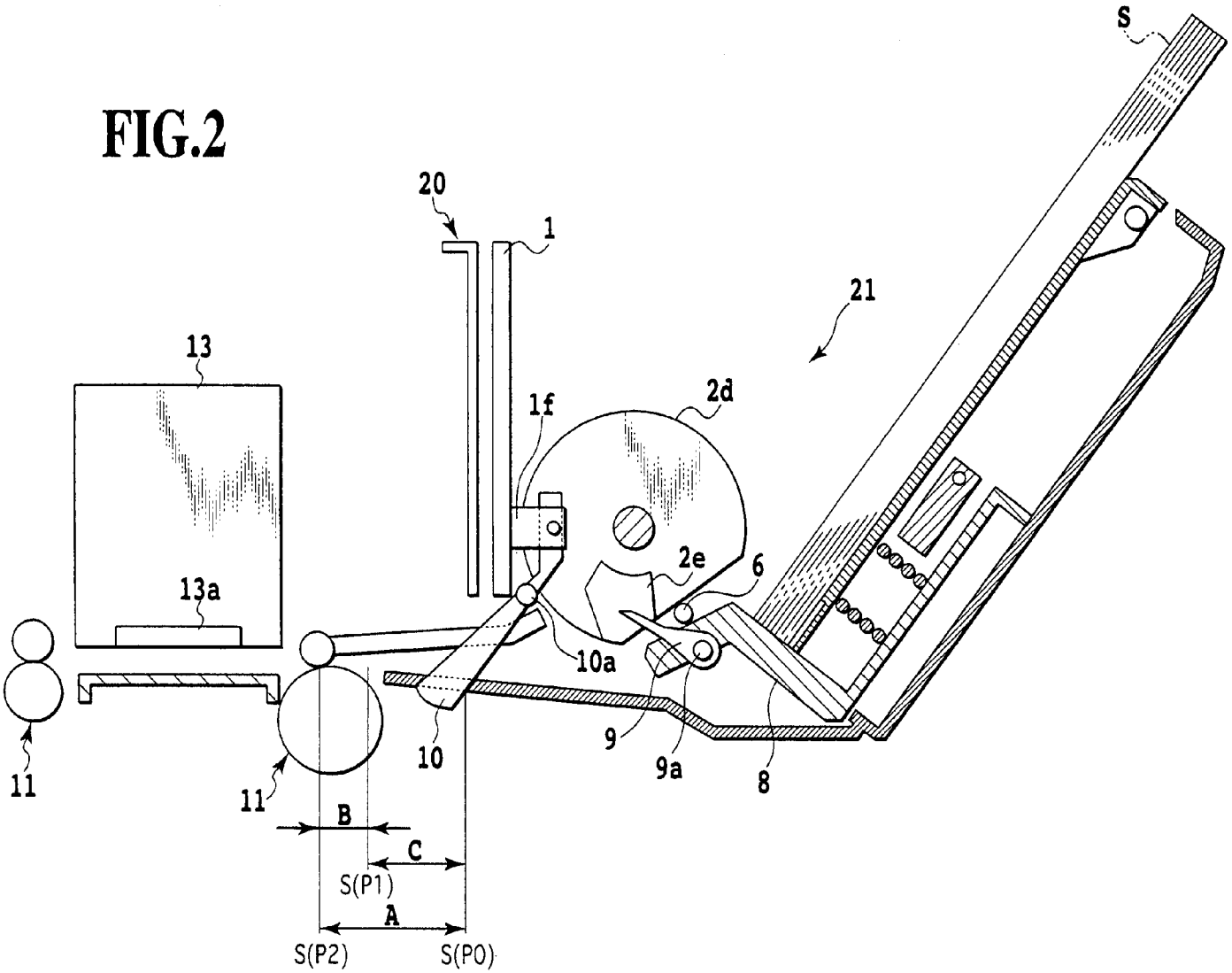
FIG. 2 is a schematic cross sectional view illustrating another main part in the printing apparatus of FIG. 1.

FIG. 1 is a schematic cross sectional view illustrating the main part of a printing apparatus according to the present invention. FIG. 2 is a schematic cross sectional view of another main part showing this printing apparatus.

In FIG. 1, the reference numeral 20 denotes a printing apparatus. This printing apparatus 20 includes, for example, the printing head unit 13 as an image formation section including a printing head 13*a*; a paper feeding apparatus (printing medium feeding apparatus) 21 for feeding the sheet (printing medium) S to a position opposed to the printing head unit 13; and a main board 1 for controlling the entirety of the printing apparatus 20. The arrow A shows a direction along which the sheet S is fed to the printing head unit 13.

The paper feeding apparatus 21 includes the feeding roller 2, a hopper 3, and the separation pad section 7. The feeding roller 2 is a sheet feeding means for feeding the sheet S contained in a sheet container section and has a substantially half moon-like cross section. The hopper 3 causes the sheet S to be abutted with feeding roller 2 in a pressurized manner. The separation pad section 7 is a separation means for separating the sheet S sent by the feeding roller 2 and includes a separation pad 7*a*.

The feeding roller 2 includes a roller rubber 2*a*, a roller axis 2*b*, a sensor flag 2*c*, and a cam (not shown) for pushing down the hopper 3 these are rotated around the roller axis 2*b* in an integrated manner. The roller rubber 2*a* contacts with the surface of the sheet S and the roller axis 2*b* is a center of gyration of the feeding roller 2. The sensor flag 2*c* blocks the light path of a transmission type feeding roller sensor 1*a* provided on the main board 1. The sensor 1*a* is a position detection means for detecting the rotation position of the feeding roller 2. The hopper 3 is structured so as to be abutted with or separated from the feeding roller 2 in conjunction with the rotation of the feeding roller 2 and uses, only when a circular section 2*a*-1 of the feeding rubber 2*a* faces the sheet S, the elastic force of a pressure contact spring 4 to cause the sheet S to be abutted with the feeding roller 2 in a pressurized manner. An operation for causing the hopper 3 to be abutted with or separated from the paper feeding roller 2 is performed by the above-described cam (not shown) included in the feeding roller 2 and the pressure contact spring 4.

The reference numeral 5 denotes a base for retaining the hopper 3 via the axis 3*a* in a rotatable manner. The reference numeral 8 denotes a separation base that is retained, in a movable manner, by the base 5 in a direction (hereinafter referred to as "sheet width direction") orthogonal to the direction along which a sheet is fed. The separation pad section 7 is attached to the separation base 8 so that the separation pad section 7 can be rotated around a rotation axis 7*b*. The reference numeral 7*c* denotes a separation pad spring and the separation pad section 7 is biased by this separation pad spring 7*c* toward the feeding roller 2.

FIG. 1 illustrates one separated sheet S being fed. In this status, a flat surface section of the feeding roller 2 (flat surface section 2*a*-2 of roller rubber 2*a*) is substantially parallel to the separation pad 7*a* and the separation pad 7*a* is stopped by a stopper section (not shown) at a position separated from the paper feeding roller 2. The feeding roller 2 is structured such that only a part in the vicinity of the circumference section (circular section 2*a*-1 of roller rubber 2*a*) is abutted with the separation pad 7*a*.

The reference numeral 6 denotes a roller that is abutted with the separation pad 7*a* to regulate a stoppage position for stopping the sheet S. This roller 6 is provided in the width direction of the sheet S at a position dislocated from the paper feeding roller 2 and is slightly pressed to the separation pad 7*a* by a spring (not shown) so that the rotation is not prevented. By slightly pressing the roller 6 to the separation pad 7*a* in the manner as described above, when the sheets S are fed, the first sheet S to be fed and the subsequent sheets S (i.e., sheets S after the first sheet S) that are moved together with the first sheet S are pressed together by the separation pad 7*a*.

In FIG. 2, the reference numeral 9 denotes a return nail as a sheet return means. This return nail 9 is provided at a position in the width direction of the sheet S dislocated from the feeding roller 2 and the roller 6 and is retained via a rotation axis 9*a* by the separation base 8 in a rotatable manner. When the sheet S is fed, this return nail 9 is inclined in the leftward direction as shown in FIG. 2. This return nail 9 is retained, when the sheet S is returned (hereinafter also referred to as "sheet return") or at a timing before the feeding of the sheet S, at a position at which the return nail 9 is rotated in the rightward direction by a spring or stopper (not shown) so as to be substantially orthogonal to the separation pad 7*a*.

The reference numeral 2*d* denotes a return nail cam section provided at the side of the feeding roller 2 that includes a concave section 2*e*. When the sheet return is performed or at timing before the feeding of the sheet S, a tip end section of the return nail 9 is inserted to this concave section 2*e* so that the return nail 9 is substantially orthogonal to the separation pad 7*a*. The reference numeral 11 denotes transportation rollers as transportation means these transport the fed sheet S or moves the printed sheet S out of the apparatus. The reference numeral 1*f* denotes a transmission type sheet end section detection sensor (PE sensor) provided on the main board 1 that is sheet end section detection means for detecting the front or rear end of the sheet S. The reference numeral 10 denotes an actuator that is pressed by the transported sheet S to be rotated around the axis 10*a*. When this actuator 10 is rotated, the PE sensor if detects the front end and the rear end of the sheet S.

Figure 3:
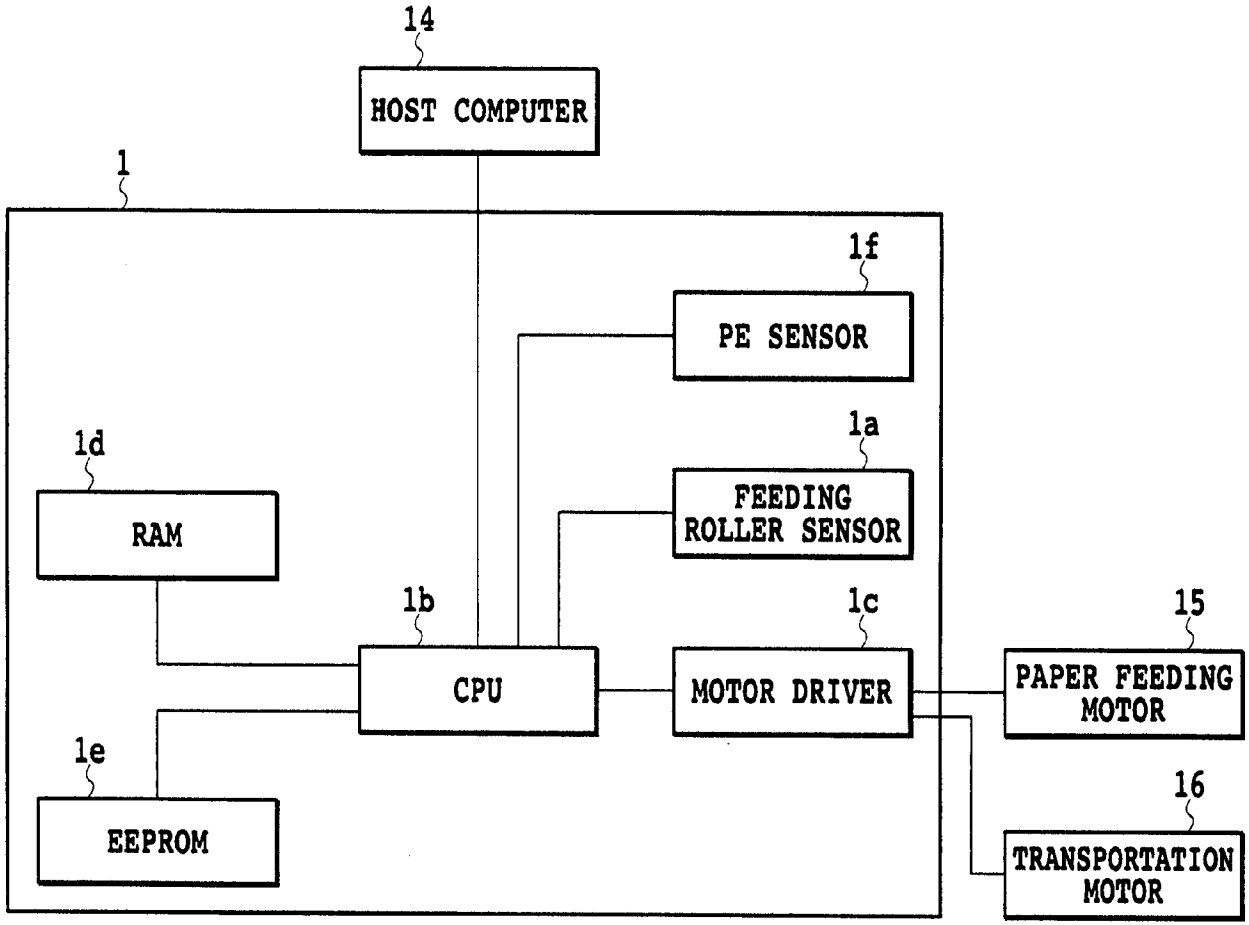
FIG. 3 is a block diagram illustrating the control system of the printing apparatus of FIG. 1.

FIG. 3 is a block diagram illustrating a drive control system for a paper feeding motor 15 for rotating the feeding roller 2 and a transportation motor 16 for rotating the transportation roller 11. In the case of this example, both of the paper feeding motor 15 and the transportation motor 16 are a stepping motor.

The reference numeral 1*b* denotes a CPU as control means that is provided on the main board 1 to control the entirety of the printing apparatus. The reference numeral 1*c* denotes a motor driver for controlling the paper feeding motor 15 and the transportation motor 16. The reference numeral 1*d* denotes a RAM for storing temporary constants. The reference numeral 1*e* denotes an EEPROM for storing operation parameters of the printing apparatus 20 (e.g., control table of paper feeding motor 15 or transportation motor 16). The reference numeral 14 denotes a host computer (host apparatus) provided in or out of the printing apparatus 20. A printing instruction is sent from this host computer 14 to the CPU 1*b*.

Next, a regular paper feeding operation in the printing apparatus 20 as described above will be described.

When a printing instruction from the host computer 14 is issued to the CPU 1*b*, the CPU 1*b* firstly determines whether the printing instruction is for the first sheet S or not. When the printing instruction is for the first sheet S, the paper feeding motor 15 is firstly forward-rotated by the motor driver 1*c* to rotate the feeding roller 2 in the clockwise direction in FIG. 1, thereby starting the feeding of the sheet S. In conjunction with this rotation of the feeding roller 2, the abutting contact between the cam section (not shown) provided with the feeding roller 2 and the hopper 3 is cancelled and the hopper 3 is rotated by the biasing force of the pressure contact spring 4 in the direction of the feeding roller 2. As a result, the bundle of sheets on the hopper 3 is pushed to the feeding roller 2. In response to the rotation of the feeding roller 2, a few sheets S positioned at the top of the bundle of sheets are transported and are fed to the separation pad section 7. Specifically, the front end of the sheet S provided on the hopper 3 is positioned so as to be abutted with a back face wall 7*d* of the separation pad section 7, and at the back face wall 7*d*, a few sheets S are started to be transported.

At this timing, in accordance with the rotation of the feeding roller 2, the sensor flag 2*c* is also rotated to change the output of the feeding roller sensor 1*a* from ON to OFF. The CPU 1*b* assumes this change of the output of the sensor 1*a* as a base point for controlling the rotation position of the feeding roller 2.

The transported sheets S is guided by a nip section between the feeding roller 2 and the separation pad 7*a*. The front end position of the sheets S at the lower side of the top sheet S is regulated by the separation pad 7*a* and the sheets S at the lower side of the top sheet S are gradually separated from the top sheet S. Finally, only the top sheet S is separated and is transported in the direction shown by the arrow A. Then, the return nail 9 is pushed by the front end of the sheet S and is rotated in the counter-clockwise direction and thus does not prevent the movement of the sheet S.

The front end of the top sheet S separated in the manner as described above reaches the position of the actuator 10, thereby rotating the actuator 10 in the clockwise direction. In accordance with this, the end section of the actuator 10 is dislocated from the light blocking section of the PE sensor 1*f*. As a result, the PE sensor 1*f* can detect the front end of the sheet.

When being inputted with the detection signal from the PE sensor 1*f*, the CPU 1*b* assumes this timing of the input as a starting point at which the motor driver 1*c* is used to start the forward rotation of the transportation motor 16 (rotation of the transportation roller 11 in the counter-clockwise direction). This timing of the input of the detection signal is also used as a starting point for an operation for transporting the sheet S to the pair of transportation rollers 11 to further transport the sheet S by the transportation rollers 11 to the printing start position. The transportation motor 16 is controlled so that the transportation roller 11 is rotated with the same peripheral velocity as that of the feeding roller 2. By the further rotation of the feeding roller 2, the front end of the sheet S fed into the printing apparatus is sandwiched by the transportation rollers 11 being forward-rotated with the same peripheral velocity as that of the feeding roller 2 and is transported.

The cam (not shown) of the feeding roller 2 pushes down the hopper 3 and the 360-degree rotation of the feeding roller 2 is stopped as shown in FIG. 1, thereby completing the paper feeding operation of the sheet S. Then, the timing at which the output of the feeding roller sensor 1*a* is ON is used as a base point for stopping the rotation of the feeding roller 2. Alternatively, the timing at which the feeding roller sensor 1*a* is OFF when the rotation of the feeding roller 2 is started also may be used as a starting point for stopping the rotation of the feeding roller 2.

Thereafter, the sheet S is transported by the transportation roller 11 driven by the transportation motor 16 to a printing start position for top alignment and is printed with an image by a printing operation of the printing head 13*a* based on to-be-printed data. The printing start position is a position corresponding to the to-be-printed data and is provided at a printing position opposed to the printing head 13*a*.

By the way, the sheets S other than the top sheet S printed with an image as described above are subjected to the friction with the top sheet S and thus are collectively fed such that they are dragged to a certain level. However, the front ends of the sheets S other than the top sheet S are pushed by the part at which the roller 6 is abutted with the separation pad 7*a* in a pressurized manner (stop position) and thus are not fed further. The structure as described above prevents a plurality of sheets S from being fed at the same time.

The printing apparatus 20 may be any apparatus such as the serial scan type one or the full-line type one for example. The printing head 13*a* may be various ink jet printing heads such as the one that can eject ink for example. A method for ejecting ink in an ink jet printing head may be any method in which an electric thermal converter (heater) or a piezoelectric element for example can be used to eject ink. When an electric thermal converter is used, thermal energy generated by the electric thermal converter is used to cause bubbles in the ink at which foaming energy is caused. This foaming energy can be used to eject ink from an ink ejecting opening.

For example, in the case of a serial scan type printing apparatus using an ink jet printing head, ink is ejected from the printing head 13*a* while alternately repeating an operation for moving the printing head 13*a* in a main scanning direction along the width direction of the sheet S and an operation for transporting the sheet S for a predetermined amount in the sub scanning direction crossing the main scanning direction, thereby printing an image on the sheet S. In the case of a full-line type printing apparatus using an ink jet printing head, a long printing head 13*a* extending in the width direction of the sheet S is used to eject ink from the printing head 13*a* to the sheet S while transporting the sheet S continuously, thereby printing an image on the sheet S.

(Simultaneous Control of Paper Ejection and Paper Feeding)

Figure 4A:
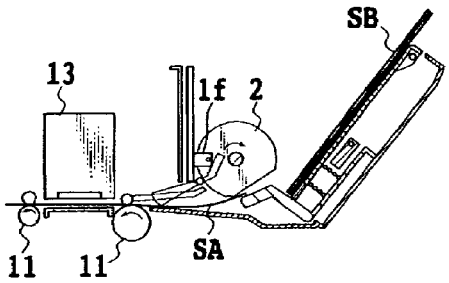
FIGS. 4A to 4G respectively illustrate a paper ejection operation and a paper feeding operation by the printing apparatus of FIG. 1.
Figure 4E:
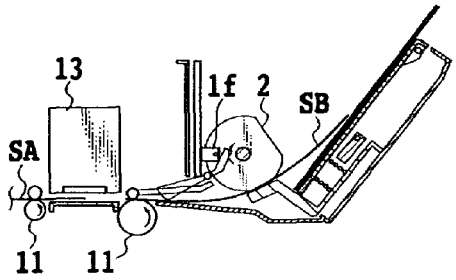
Figure 4B:
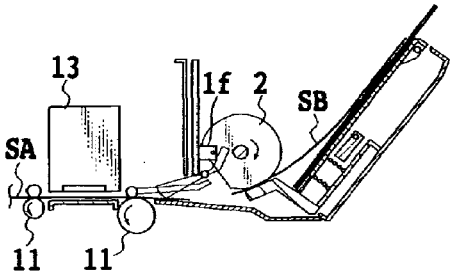
Figure 4F:
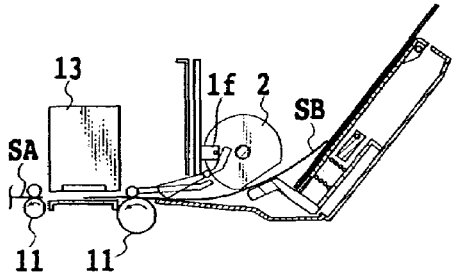
Figure 4C:
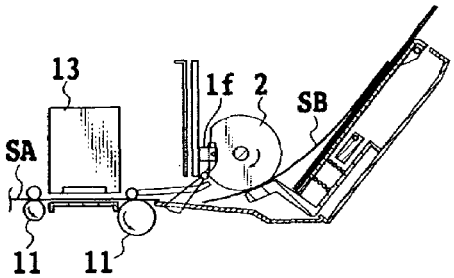
Figure 4G:
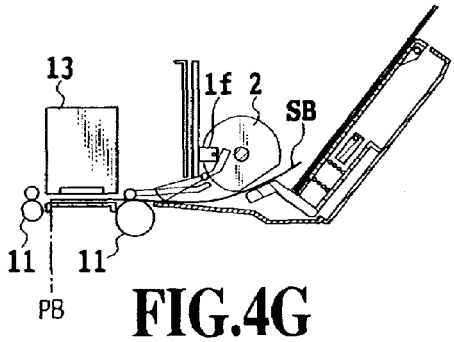
Figure 4D:
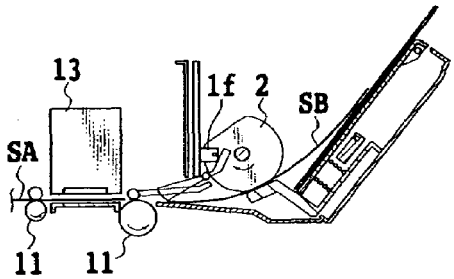
Figure 5:
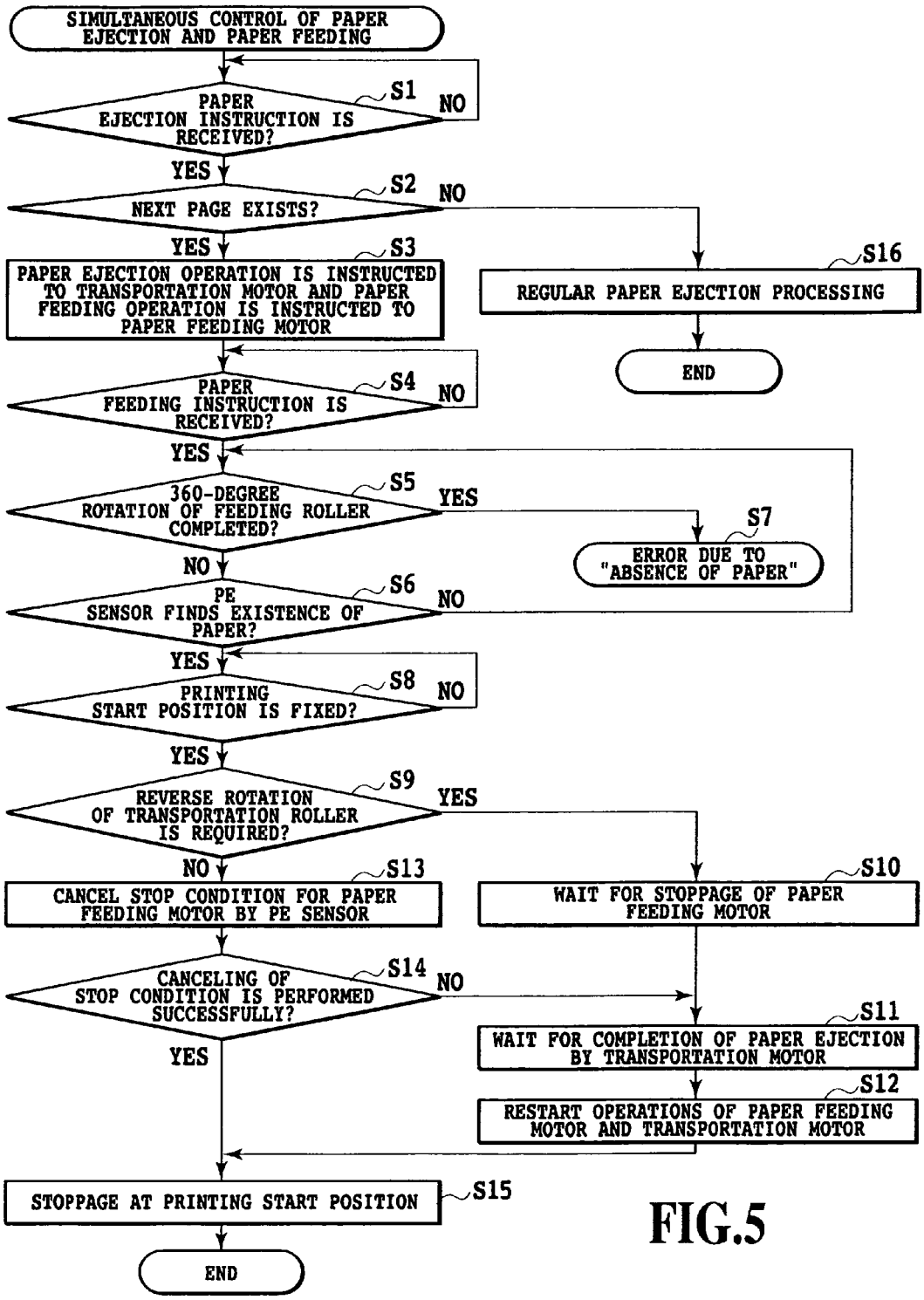
FIG. 5 is a flowchart illustrating the simultaneous control of paper ejection and paper feeding in the printing apparatus of FIG. 1.

Next, "simultaneous control of paper ejection and paper feeding" in which a paper ejection operation of the sheet S is performed simultaneously with a paper feeding operation in the structure as described above will be described. FIG. 4A to FIG. 4G illustrate the operation status of the simultaneous control of the paper ejection and the paper feeding. FIG. 5 is a flowchart for illustrating the simultaneous control of the paper ejection and the paper feeding.

First, a paper ejection instruction is received (Step S1). Next, whether or not a next page to be printed exists is determined. When such a next page does not exist, then a regular paper ejection processing for regularly ejecting a printed sheet is performed (Step S16).

When a next page exists, then the simultaneous control of the paper ejection and the paper feeding is started as described below.

First, a paper ejection operation is instructed to the transportation motor 16 and a paper feeding instruction is instructed to the paper feeding motor 15 (Step S3). As a result, an operation for ejecting the first sheet SA and an operation for feeding the second sheet SB are simultaneously performed as shown in FIG. 4A, FIG. 4B, and FIG. 4C.

The instruction for the operation for feeding a paper to the paper feeding motor 15 is associated with the first and second conditions for stopping the paper feeding motor 15. The first stop condition is a regular condition for stopping the paper feeding motor 15 when the feeding roller 2 is rotated 360 degrees. The second stop condition is a condition in which, when the PE sensor 1*f* detects the sheet front end at the front end detection position S (P0) as shown in FIG. 2 and the sheet is fed to the front end stop position S (P1) far away by the predetermined distance C, the feeding roller 2 is stopped (hereinafter also referred to as "stop condition by PE sensor"). Thus, when the stop condition by the PE sensor (the second stop condition) is not canceled as described below, the paper feeding motor 15 is stopped when this stop condition is satisfied. The distance "A" in FIG. 2 is from the sheet front end detection position S (P0) by the PE sensor 1*f* to the position S (P2) of the transportation roller 11. By deducting the margin distance "B" from this distance "A", the front end stop position S (P1) can be calculated. The margin distance "B" is a distance for separating the sheet front end from the transportation roller 11 so that the sheet front end is prevented from being caught by the transportation roller 11.

Next, the reception of a paper feeding instruction for feeding the sheet SA is waited (Step S4). By receiving the paper feeding instruction, whether or not the feeding roller 2 has completed one round (Step S5) and whether or not the PE sensor 1*f* detects the existence of a paper (Step S6) are determined. When the feeding roller 2 has completed one round (when the first stop condition is satisfied), it is determined that the sheet P does not exist (i.e., absence of paper) and an error processing is provided to complete the whole process (Step S7). When the PE sensor 1*f* detects the existence of a paper as shown in FIG. 4D, the fixation of the printing start position PB is waited (Step S8).

The fixation of the printing start position PB is performed in the manner as described below. When a paper feeding instruction from the host computer 14 is received, then the sheet front end section is set at the temporary printing start position PB. Then, a predetermined amount of to-be-printed data is consecutively received with regards to a part from the front end section to the rear end section of the sheet. When the data at the front end of the received to-be-printed data is data representing a blank, a position obtained by moving the temporary printing start position PB to the rear end section by a predetermined amount is set again as the temporary printing start position PB. So long as to-be-printed data representing blank area is received, the setting as described above is repeated. When to-be-printed data not representing blank area is received, the printing position of the to-be-printed data is determined as the printing start position PB. By receiving the to-be-printed data not representing blank area, the printing start position PB is fixed.

When the printing start position PB is fixed, whether or not the reverse rotation of the transportation roller 11 is required is determined based on the relation between the remaining rotation amount until the 360-degree rotation of the feeding roller 2 is reached and the printing start position PB (Step S9). Specifically, the transportation-completed position of the sheet SB when the 360-degree rotation of the feeding roller 2 is completed is estimated and, when the transportation-completed position comes ahead of the printing start position PB, it is determined that the reverse rotation of the transportation roller 11 for returning the front end of the sheet SB to the printing start position PB is required. When the transportation-completed position does not come ahead of the printing start position PB on the other hand, it is determined that the reverse rotation of the transportation roller 11 is not required.

When it is determined that the reverse rotation of the transportation roller 11 is required, the stoppage of the paper feeding motor 15 is waited (Step S10). In this case, the stop condition by the PE sensor (the second stop condition) is not cancelled and thus the paper feeding motor 15 is stopped when the front end of the sheet SB is fed to the front end stop position S (P1) in FIG. 2. Thereafter, the completion of the paper ejection operation by the transportation motor 16 is waited (Step S11) and the operations of the paper feeding motor 15 and the transportation motor 16 are started (Step S12) and the sheet SB is transported to the printing start position PB, thereby completing the entire processing (Step S15). In accordance with the normal rotation of the transportation roller 11, the sheet SB is positioned at the printing start position PB.

When it is determined that the reverse rotation of the transportation roller 11 is not required on the other hand, the paper feeding motor 15 is instructed to cancel the stop condition by the PE sensor 1*f* (the second stop condition) (Step S13). When this canceling of the stop condition is successfully performed in Step S14, the processing proceeds to Step S15. When this canceling of the stop condition is not successfully performed, the processing proceeds to Step S11. A presumable example in which the canceling of the stop condition in Step S14 is not successfully performed may be the third case which will be described later. On the other hand, in order to transport the sheet SB to the printing start position PB in Step S15, the 360-degree rotation of the feeding roller 2 is completed as shown in FIG. 4E, FIG. 4F, and FIG. 4G to subsequently use the transportation motor 16 to transport the sheet S to the printing start position PB.

Figure 6:
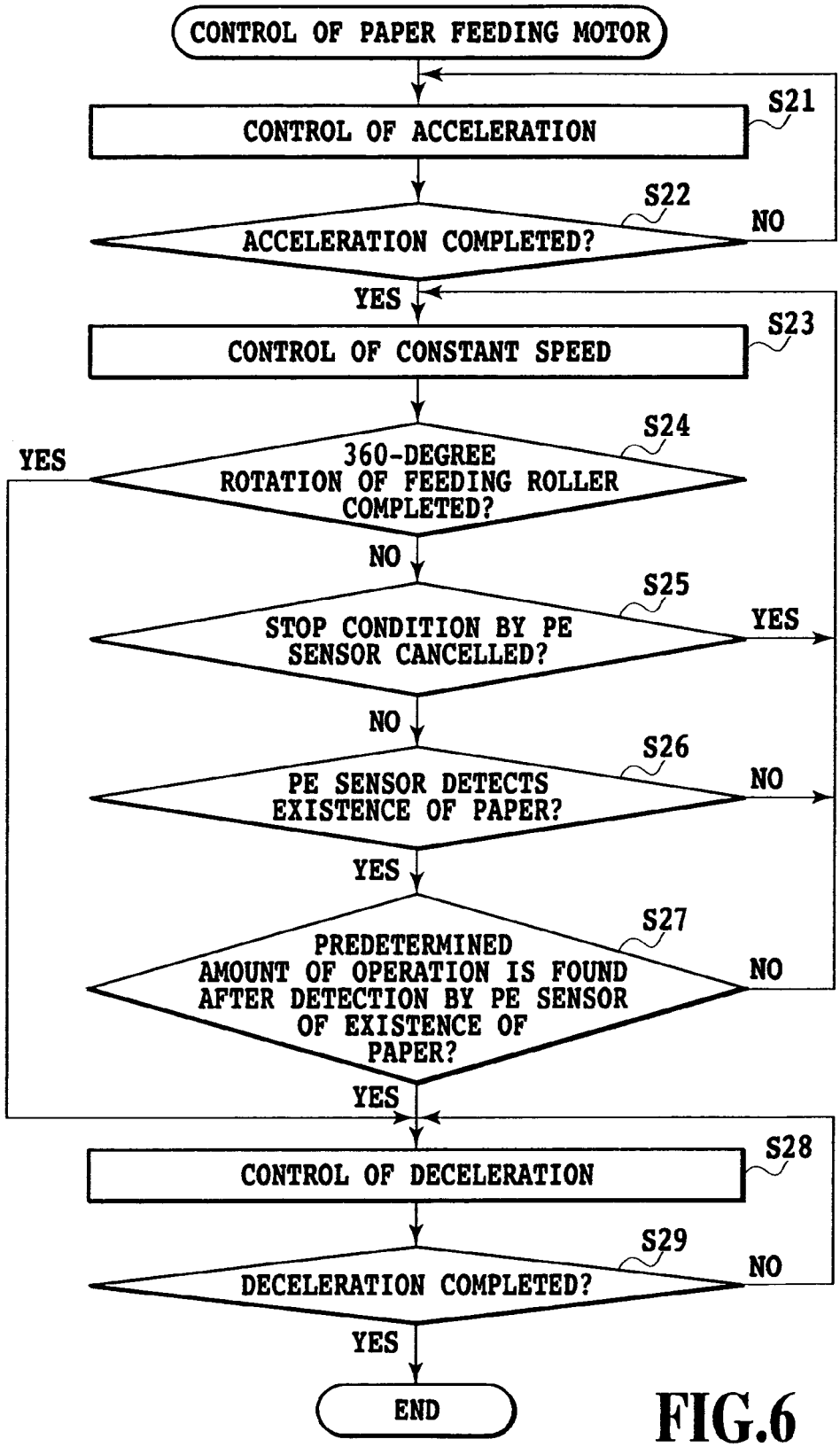
FIG. 6 is a flowchart illustrating the control of a paper feeding motor in the printing apparatus of FIG. 1.

FIG. 6 is a flowchart for explaining the process for controlling the paper feeding motor 15. This processing is performed by the interrupt by the cycle timer.

When an instruction for the operation of the paper feeding motor 15 is received, then the paper feeding motor 15 is subjected to an acceleration control (Step S21) and, when the paper feeding motor 15 is accelerated to have a predetermined speed, then the paper feeding motor 15 is subjected to a constant speed control (Steps S22 and S23). When the 360-degree rotation of the feeding roller 2 is performed (Step S24), then the control is switched to the control of the deceleration of the paper feeding motor 15 (Step S28). When the stop condition for the paper feeding motor 15 by the PE sensor 1*f* (the first stop condition) is not cancelled (Step S25) and the paper feeding motor 15 has operated with a predetermined amount (an operation for transporting the sheet S for a predetermined distance) since the PE sensor 1*f* detects the existence of a paper (Steps S26 and S25), then the control is switched to the control of the deceleration of the paper feeding motor 15 (Step S28). The predetermined distance is a distance obtained by deducting, from the distance C to the front end stop position S (P1) in FIG. 2, a deceleration distance required for the paper feeding motor 15 to be decelerated to be stopped. Then, the completion of the deceleration of the paper feeding motor 15 is waited (Step S9), thereby completing the processing.

Figure 7:
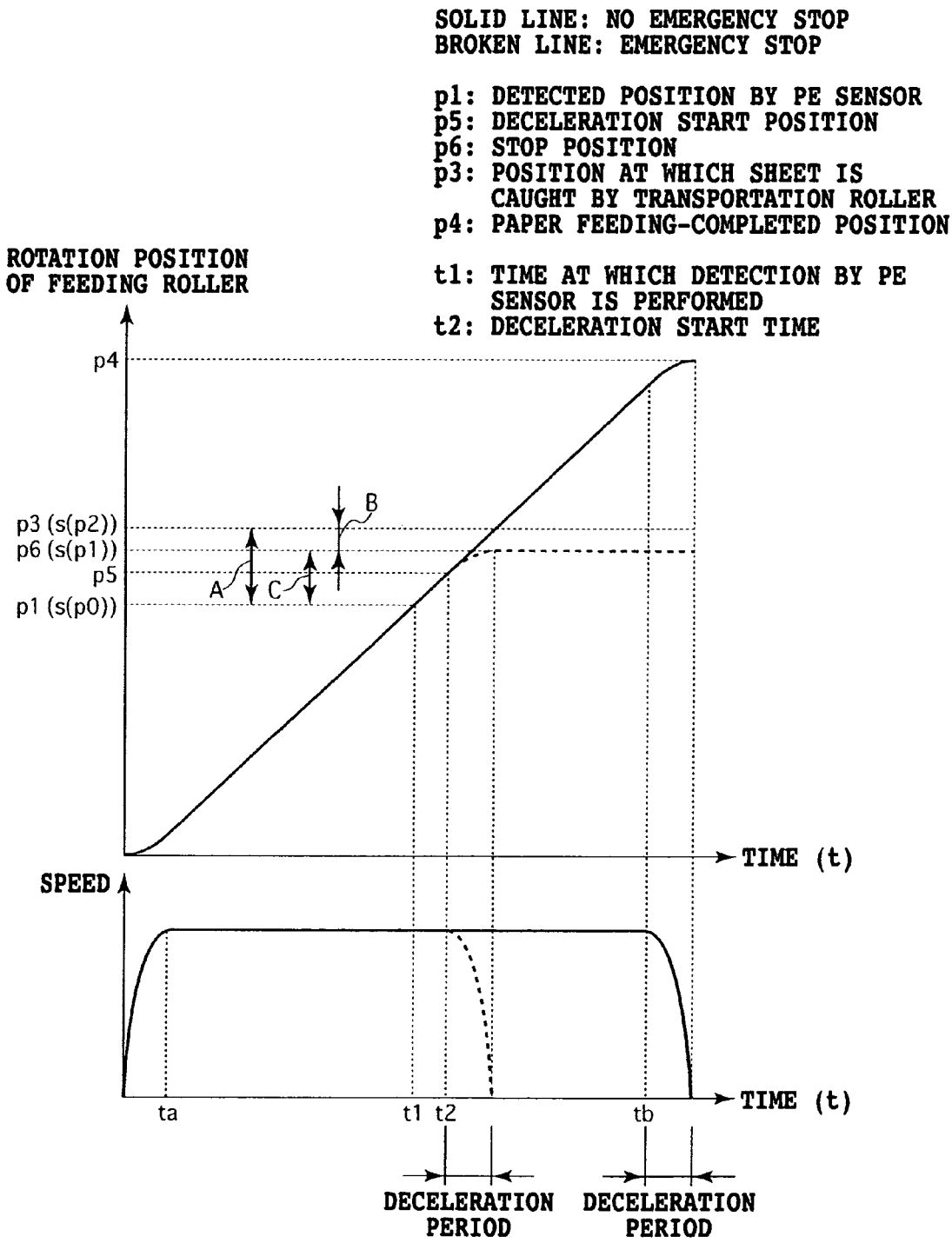
FIG. 7 illustrates the operation of a feeding roller in the printing apparatus of FIG. 1.
Figure 8A:
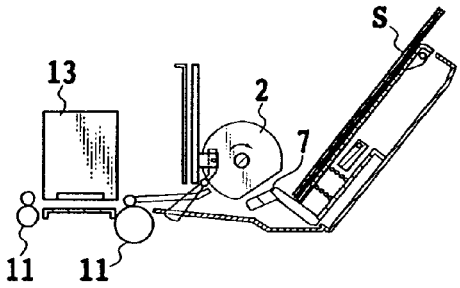
FIGS. 8A to 8F respectively illustrate a paper feeding operation by a conventional printing apparatus.
Figure 8D:
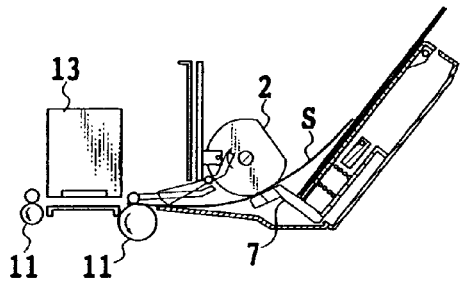
Figure 8B:
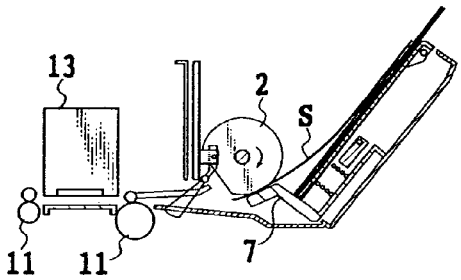
Figure 8E:
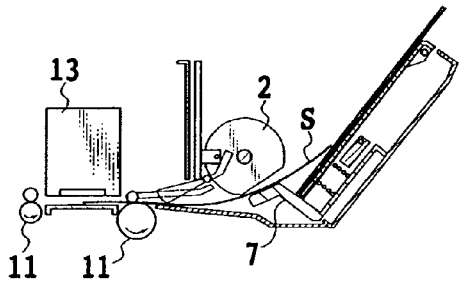
Figure 8C:
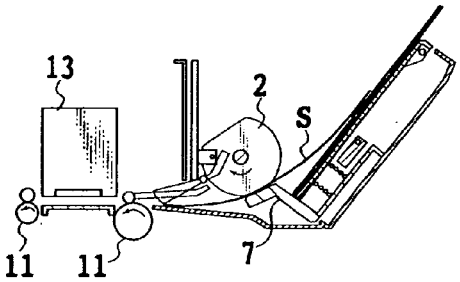
Figure 8F:
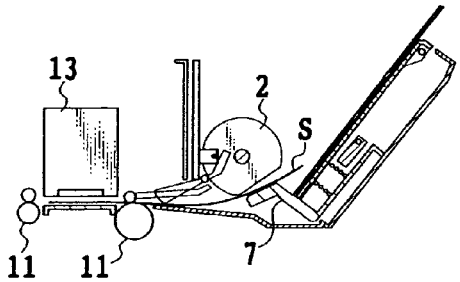
Figure 9A:
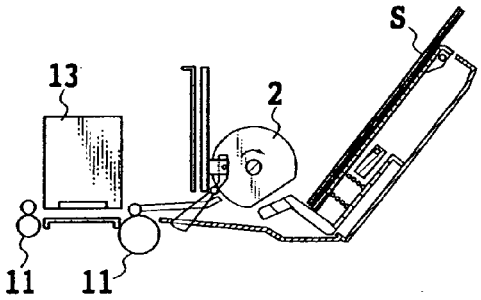
FIGS. 9A to 9F respectively illustrate a paper feeding operation by another conventional printing apparatus.
Figure 9D:
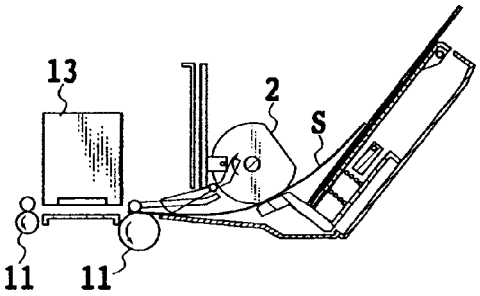
Figure 9B:
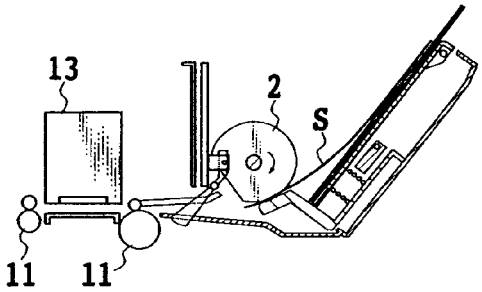
Figure 9E:
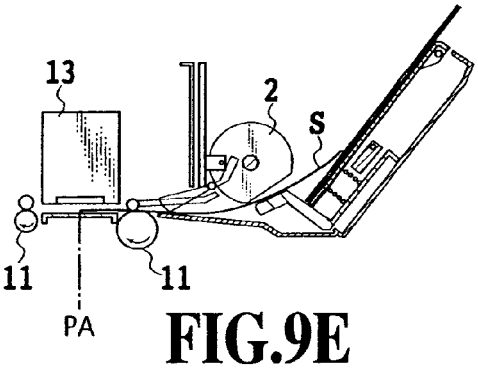
Figure 9C:
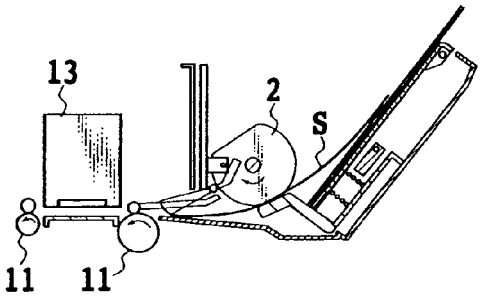
Figure 9F:
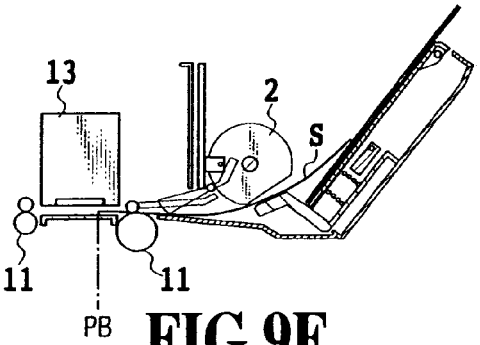
Figure 10A:
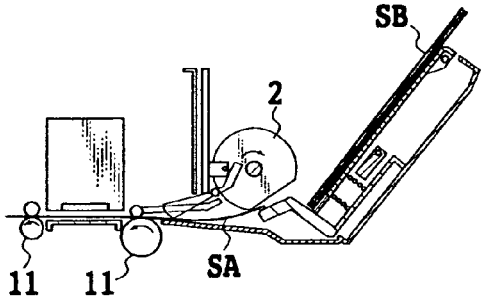
FIGS. 10A to 10G respectively illustrate a paper ejection operation and a paper feeding operation by still another conventional printing apparatus.
Figure 10E:
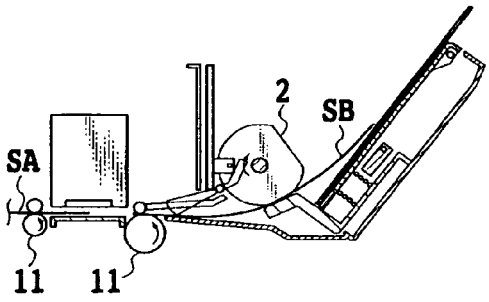
Figure 10B:
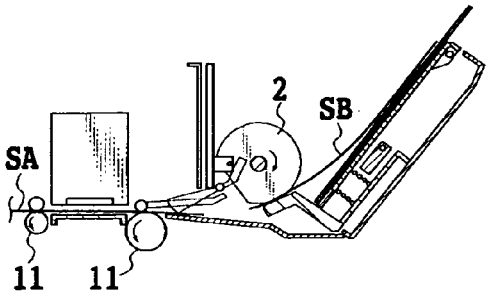
Figure 10F:
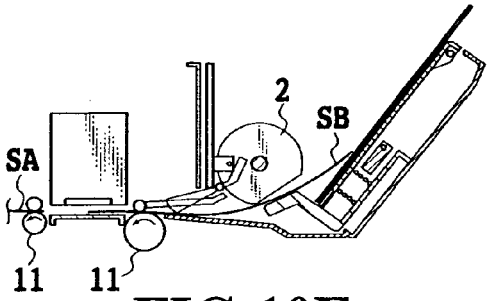
Figure 10C:
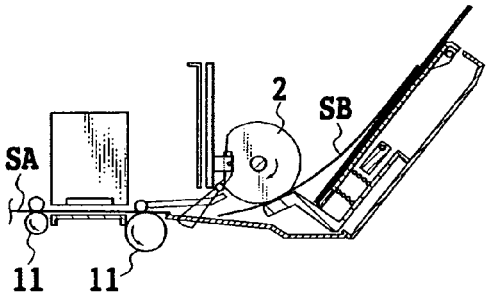
Figure 10G:
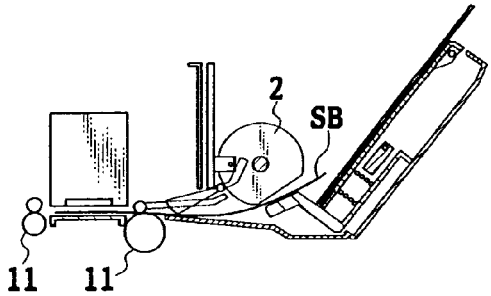
Figure 10D:
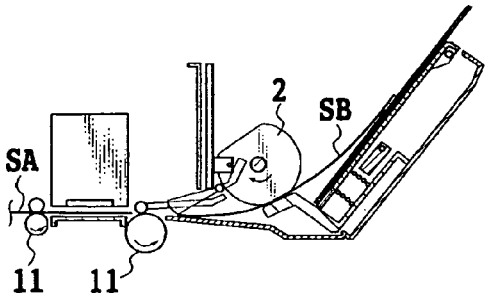
Figure 11A:
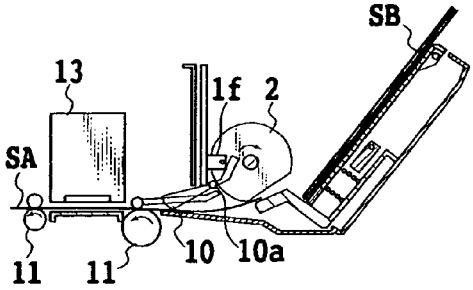
FIGS. 11A to 11G respectively illustrate a paper ejection operation and a paper feeding operation by still another conventional printing apparatus.
Figure 11E:
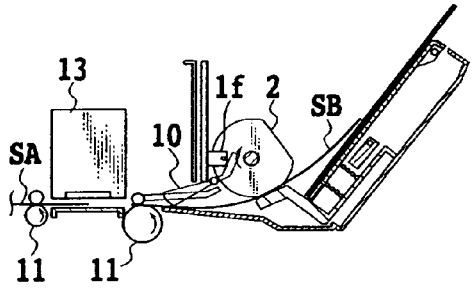
Figure 11B:
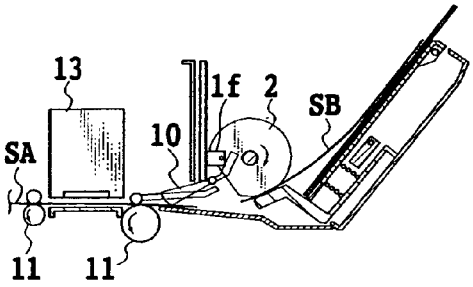
Figure 11F:
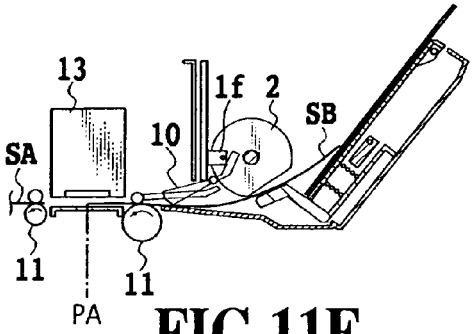
Figure 11C:
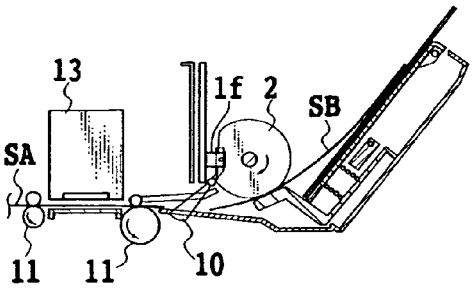
Figure 11G:
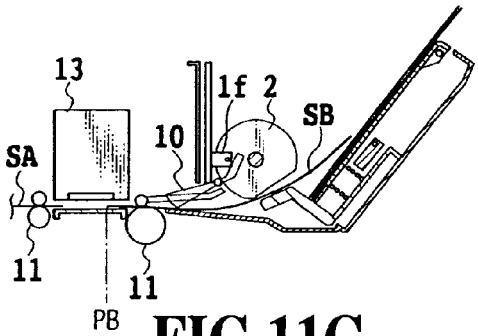
Figure 11D:
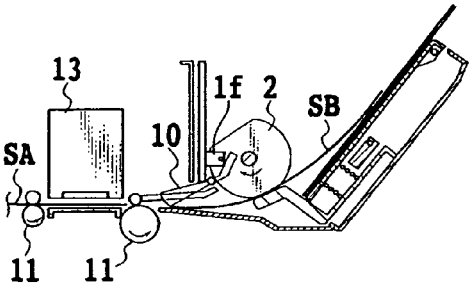
Figure 12A:
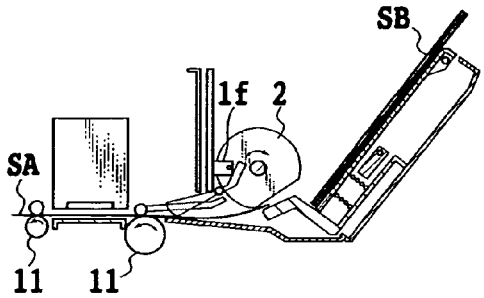
FIGS. 12A to 12I respectively illustrate a paper ejection operation and a paper feeding operation by still another conventional printing apparatus.
Figure 12B:
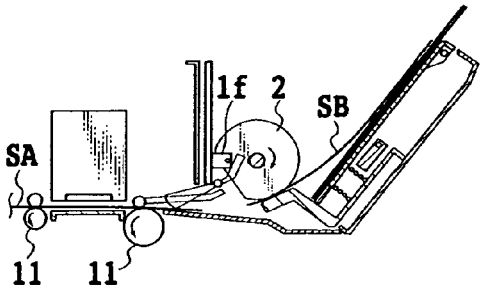
Figure 12C:
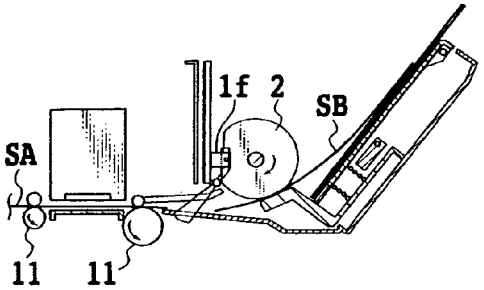
Figure 12D:
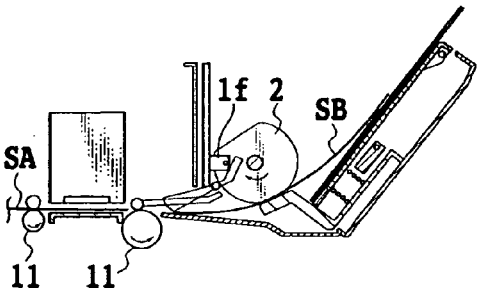
Figure 12E:
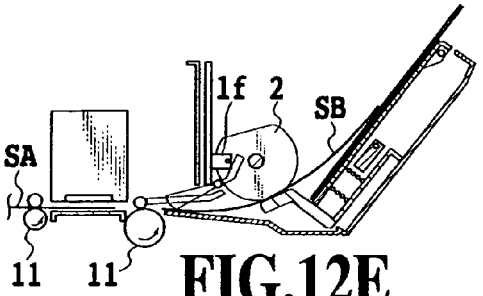
Figure 12F:
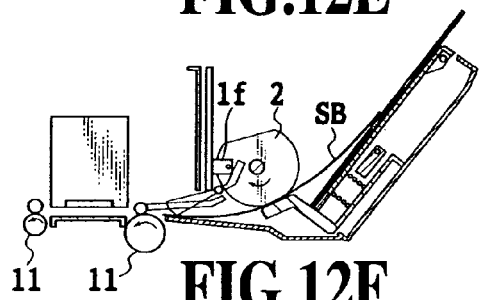
Figure 12G:
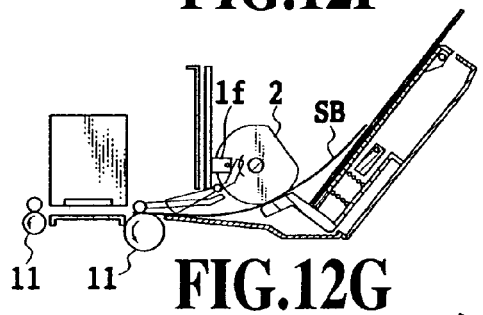
Figure 12H:
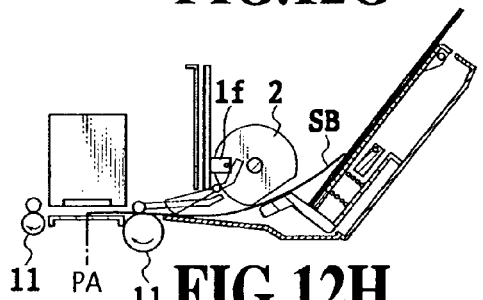
Figure 12I:
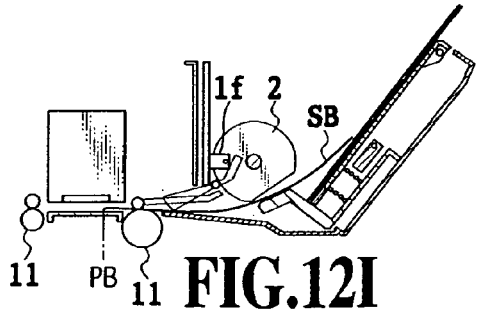
Figure 13:
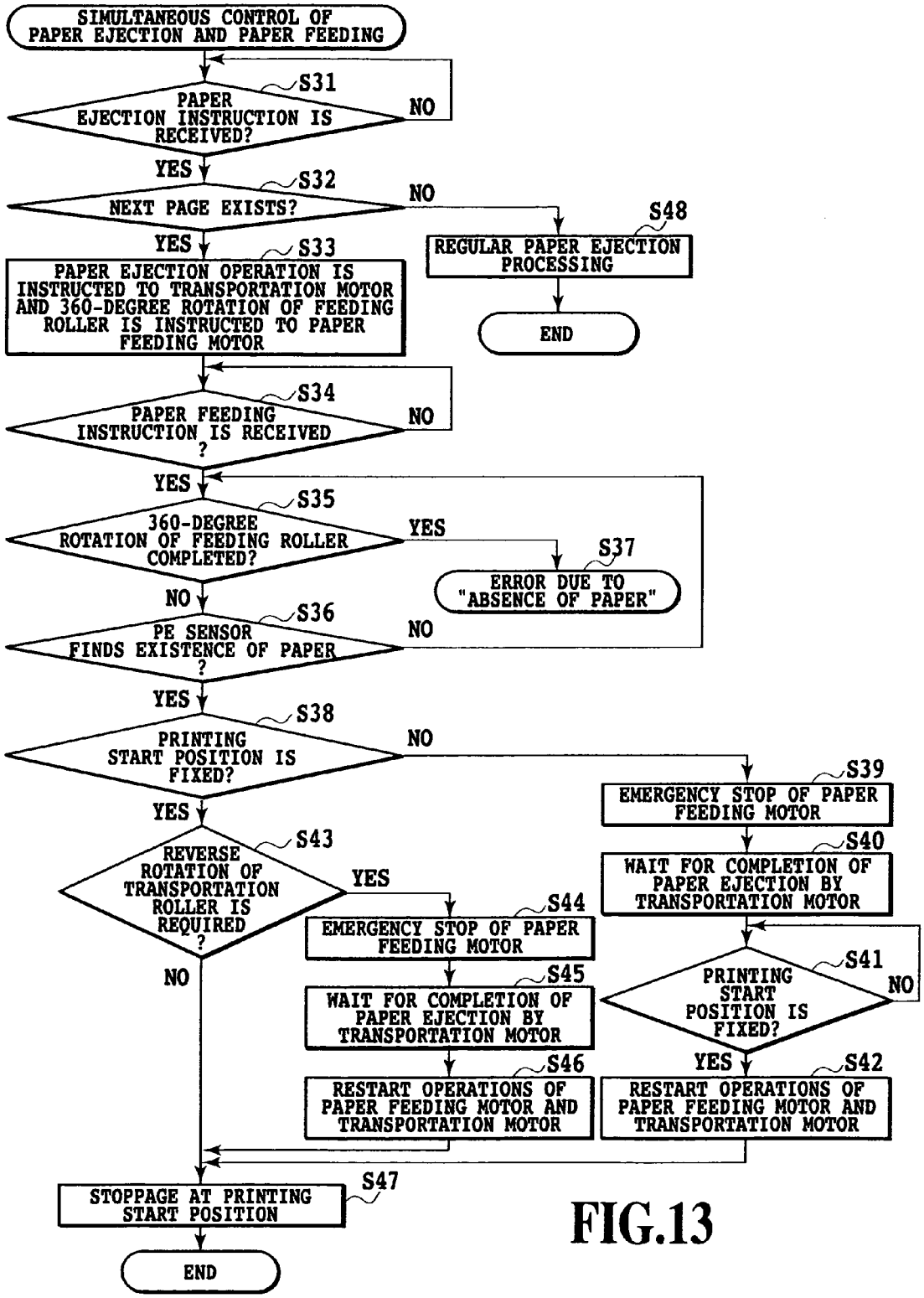
FIG. 13 is a flowchart illustrating a simultaneous control of a paper ejection operation and a paper feeding operation in a conventional printing apparatus.
Figure 14:
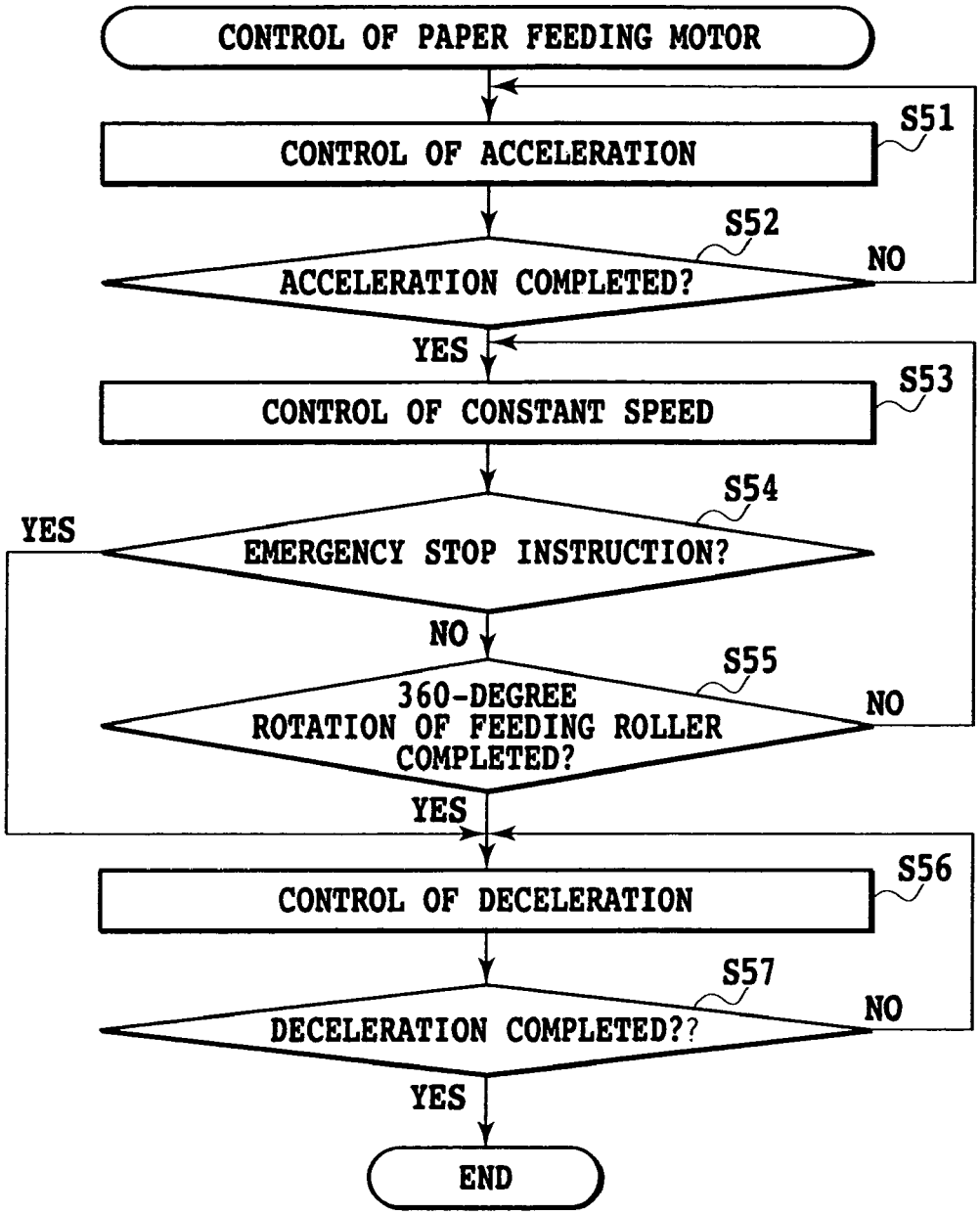
FIG. 14 is a flowchart illustrating a control of a paper feeding motor in a conventional printing apparatus.

FIG. 7 illustrates the control status of the feeding roller 2.

When the driving by the paper feeding motor 15 is started, the rotation position of the feeding roller 2 proceeds. A period from the start of the rotation of the paper feeding motor 15 to the time "ta" is a period of the acceleration control in Step S2 in FIG. 6. The period as shown by the solid line in FIG. 7 from the time "tb" to the stoppage of the rotation of the paper feeding motor 15 and the period as shown by the broken line in FIG. 7 from the time "t2" to the stoppage of the rotation of the paper feeding motor 15 are the period during which the deceleration control in Step S28 in FIG. 6 is performed.

At the time "t1", the PE sensor 1*f* detects the front end of one separated sheet S (the existence of a paper). The rotation position of the feeding roller 2 at this timing is assumed as "P1". These position P1 and time t1 are moved forward or backward depending on the behavior of the sheet S. At the time t1, the processing proceeds from Step S6 to Step S8 in FIG. 5 and the fixation of the printing start position PB is waited. The PE sensor 1*f* detects the existence of a paper in Step S26 of FIG. 6 and then the paper feeding motor 15 operates with a predetermined amount in Step S27 at which the time t2 is reached. The rotation position of the feeding roller 2 at the time t2 is assumed as P5. As shown by the broken line in FIG. 7, the deceleration of the paper feeding motor 15 is started from the time t2 and is stopped at which the rotation position of the feeding roller 2 is assumed as P6.

The rotation position P1 corresponds to a rotation position when the front end of the sheet S is transported to the front end detection position (S(P0)) in FIG. 2. The rotation position P6 corresponds to a rotation position when the front end of the sheet S is stopped at the front end stop position (S(P1)) in FIG. 2. Thus, the time t2 is a time for starting the deceleration period for stopping the front end of the sheet S to the front end stop position (S(P1)) in FIG. 2. The rotation position P5 is the rotation position at this timing. The distances A, B, and C in FIG. 2 respectively correspond to the rotation amount from the rotation position p1 to the rotation position p3, the rotation amount from the rotation position p6 to the rotation position p3, and the rotation amount from the rotation position p1 to the rotation position p6.

When it is determined that the printing start position PB is fixed in Step S8 of FIG. 5, the subsequent processing is provided in the three cases as described below depending on when the printing start position PB is fixed.

First case: the processing when the printing start position PB is fixed until the time t1.

Second case: the processing when the printing start position PB is fixed during a period from the time t1 to the time t2.

Third case: the processing when the printing start position PB is not fixed until the time t2.

In the following section, details of the processing for these first, second, and third cases will be separately described.

(First Case)

When the printing start position PB is fixed until the time t1, the processing proceeds from Step S8 to Step S9 in FIG. 5 to determine whether the reverse rotation of the transportation roller 11 is required or not.

When the reverse rotation of the transportation roller 11 is required, the processing proceeds to Step S10 and the stoppage of the paper feeding motor 15 is waited. Since the stop condition by the PE sensor 1*f* for the paper feeding motor 15 (the second stop condition) is not cancelled, the result of the determination by Step 27 in FIG. 6 in the subsequent time t2 causes the processing to proceed to Step S28 to start the deceleration control. In this case, the rotation position and speed of the feeding roller 2 change so as to draw the trajectory shown by the broken line in FIG. 7. By temporarily stopping the paper feeding operation as described above, the completion of the paper ejection is waited in Step S11 of FIG. 5.

When it is determined that the reverse rotation of the transportation roller 11 is not required in Step S9 on the other hand, Step S13 cancels the stop condition by the PE sensor if for the paper feeding motor 15 (the second stop condition). As a result, the determination of Step S25 in FIG. 6 is "YES" and the deceleration of the paper feeding motor 15 is not started until the 360-degree rotation of the feeding roller 2 is completed. When the stop condition by the PE sensor if for the paper feeding motor 15 (the second stop condition) is cancelled successfully, the processing proceeds from Step S14 to Step S15 in FIG. 5 and the sheet SB is transported to the printing start position PB without being stopped halfway. In this case, the rotation position and speed of the feeding roller 2 change so as to draw the trajectory as shown by the solid line in FIG. 7.

The operation in this first case is the same as that in the above-described conventional example.

(Second Case)

When the printing start position PB is fixed during a period from the time t1 to the time t2, the processing proceeds to Step S9 of FIG. 5 when the printing start position PB is fixed to determine whether or not the reverse rotation of the transportation roller 11 is required or not.

Figure 15:
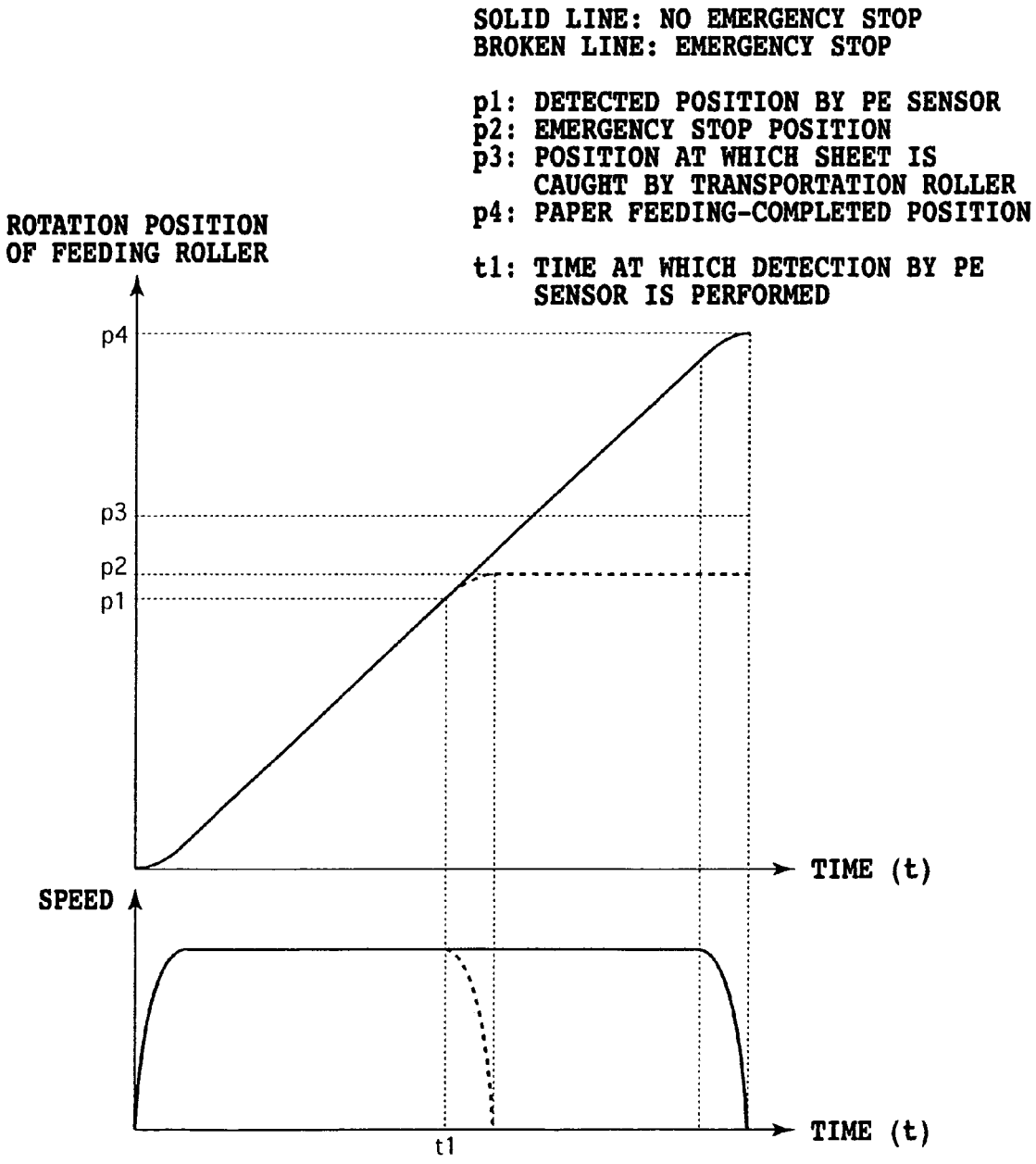
FIG. 15 illustrates an operation of a feeding roller by the simultaneous control of the paper ejection operation and the paper feeding operation of FIG. 13.

When the reverse rotation of the transportation roller 11 is required, the processing proceeds to Step S10 and the stoppage of the paper feeding motor 15 is waited. Since the stop condition by the PE sensor 1*f* for the paper feeding motor 15 (the second stop condition) is not cancelled, the result of the determination of the subsequent Step S27 at the time t2 causes the processing to proceed to Step S28 to start the deceleration control. In this case, the rotation position and speed of the feeding roller 2 change so as to draw the trajectory as shown by the broken line in FIG. 15. The paper feeding operation is temporarily stopped in the manner as described above and the completion of the paper ejection is waited in Step S11 of FIG. 5.

When Step S9 in FIG. 5 determines that the reverse rotation of the transportation roller 11 is not required on the other hand, Step S13 cancels the stop condition by the PE sensor if for the paper feeding motor 15 (the second stop condition). Since the time t2 is not yet reached, the result of the determination in Step S27 of FIG. 6 is "NO". Since the result of the determination in Step S25 is "YES", the deceleration control in Step S28 is not started until the 360-degree rotation of the feeding roller 2 is obtained. When the stop condition by the PE sensor 1*f* (the second stop condition) is cancelled, the processing proceeds from Step S14 to Step S15 in FIG. 5 and the feeding roller 2 transports the sheet S to the printing start position PB without being stopped halfway. In this case, the rotation position and speed of the feeding roller 2 change so as to draw the trajectory as shown by the solid line in FIG. 7.

The operation in the second case is improved when compared to the above-described conventional example. Specifically, in the above-described conventional example, when the printing start position is not fixed at the time t1, the paper feeding motor was immediately subjected to an emergency stop. However, if the printing start position is fixed until the time t2, this embodiment can realize high-speed paper ejection and paper feeding operations without stopping the paper feeding motor 15, even when the printing start position is not fixed at the time t1.

(Third Case)

When the printing start position is not fixed until the time t2 and when the time t2 is reached, the processing proceeds from Step S8 to Step S9 in FIG. 5. Thus, the stop condition by the PE sensor if for the paper feeding motor 15 (the second stop condition) is not cancelled and the result of the determination at the time t2 in Step S27 causes the processing to proceed to Step S28, thereby starting the deceleration control. In this case, the rotation position and speed of the feeding roller 2 change so as to draw the trajectory as shown by the broken line in FIG. 7. Even when Step S9 determines that the reverse rotation of the transportation roller 11 is not required and Step S13 cancels the stop condition by the PE sensor if for the paper feeding motor 15 (the second stop condition), the deceleration of the paper feeding motor 15 is already started at this timing. In such a case, it is determined that the canceling of the stop condition by the PE sensor 1*f* (the second stop condition) is failed and the processing proceeds from Step S14 to Step S11. As a result, the paper feeding operation is temporarily stopped. The operation in this third case is the same as that in the above-described conventional example.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2004-238863 filed Aug. 18, 2004, which is hereby incorporated by reference herein.

What is claimed is:

1. A printing apparatus in which a printing medium fed from feeding means is transported by transportation means to a printing start position to subsequently print an image on the printing medium, comprising:

end section detection means for detecting an end section of the printing medium fed by the feeding means; and control means for starting, before obtaining information regarding a printing start position, the feeding of the printing medium by the feeding means and for determining whether or not to stop the feeding means when obtaining the information regarding the printing start position within a predetermined period after the detection of a front end of the printing medium by the end section detection means, wherein the predetermined period is a period during which the printing medium can be stopped at a predetermined position before being caught by the transportation means.

2. A printing apparatus according to claim 1, wherein the control means determines whether or not there is a situation in which the feeding means is not stopped based on the information regarding the printing start position obtained within the predetermined period.

3. A printing apparatus according to claim 1, wherein the predetermined position is a position at which the printing medium is fed for a predetermined distance since the front end of the printing medium is detected by the end section detection means.

4. A printing apparatus according to claim 1, wherein the control means stops the feeding means to subsequently wait for the completion of the transportation of a preceding printing medium by the transportation means to restart the operation for feeding a succeeding printing medium by the feeding means.

5. A printing apparatus according to claim 1, wherein the control means starts, in the middle of the operation by the transportation means for transporting a preceding printing medium, the operation by the feeding means for feeding a preceding printing medium.

6. A printing apparatus according to claim 1, wherein the transportation means includes a transportation roller that can be rotated in the reverse direction while being abutted with the printing medium.

7. A printing apparatus for printing an image on a printing medium, comprising:

feeding means for feeding the printing medium to transportation means for transporting the printing medium to a printing start position;

end section detection means for detecting an end section of the printing medium fed by the feeding means; and canceling means for canceling a stop condition for stopping the printing medium at a predetermined position at which the printing medium is fed for a predetermined distance after the detection of a front end of the printing medium by the end section detection means and at which the printing medium is not yet caught by the transportation means, wherein the canceling means obtains information regarding the printing start position within a period from the detection of the front end of the printing medium by the end section detection means to a timing at which a predetermined period has passed and determines, based on the obtained information, whether or not to cancel the stop condition and, when the stop condition is determined to be canceled, the canceling means cancels the stop condition.

8. A method for feeding a printing medium by feeding means to transportation means for transporting the printing medium to a printing start position, comprising:

a step of starting, prior to a obtainment of information regarding a printing start position, the feeding of the printing medium by the feeding means, a step of detecting an end section of the printing medium fed by the feeding means; and a step of determining whether or not to stop the feeding means when the information regarding the printing start position is obtained within a predetermined period after the detection of a front end of the printing medium in the end section detection step, wherein the predetermined period is a period during which the printing medium can be stopped at a predetermined position at which the printing medium is not yet caught by the transportation means.

9. A method for feeding a printing medium by feeding means to transportation means for transporting the printing medium to a printing start position, comprising:

a step of detecting an end section of the printing medium fed by the feeding means; and a step of canceling a stop condition for stopping the printing medium at a predetermined position at which the printing medium is fed for a predetermined distance after the detection of a front end of the printing medium in the end section detection step and at which the printing medium is not yet caught by the transportation means, wherein the canceling step obtains information regarding the printing start position within a period from the detection of a front end of the printing medium in the end section detection step to a timing at which a predetermined period has passed and determines, based on the obtained information, whether or not to cancel the stop condition and, when the stop condition is determined to be canceled, the canceling step cancels the stop condition.

* * * * *